US012660979B2

(12) United States Patent
Shim et al.

(10) Patent No.: US 12,660,979 B2
(45) Date of Patent: Jun. 23, 2026

(54) COMBINED TYPE SENSOR DEVICE COMBINED WITH SENSOR MODULE

(71) Applicant: LG ELECTRONICS INC., Seoul (KR)

(72) Inventors: Hongjo Shim, Seoul (KR); Seonghyok Kim, Seoul (KR); Hyunwoo Kim, Seoul (KR); Joomin Kim, Seoul (KR); Chihwan Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 821 days.

(21) Appl. No.: 17/881,269

(22) Filed: Aug. 4, 2022

(65) Prior Publication Data

US 2023/0329516 A1 Oct. 19, 2023

(30) Foreign Application Priority Data

Apr. 14, 2022 (KR) ..... 10-2022-0046048

(51) Int. Cl.
*A47L 15/00* (2006.01)

(52) U.S. Cl.
CPC ..... *A47L 15/0063* (2013.01); *A47L 15/006* (2013.01)

(58) Field of Classification Search
CPC ..... G01D 21/00; G01D 21/02; D06F 34/05; D06F 34/22; H04L 12/2814; H04L 2012/2841; H04L 2012/285; H04L 67/2869; H04L 12/2823; H04L 67/34; G06F 8/65; G06F 9/4411; H04W 4/80; A47L 15/0063; A47L 15/006
See application file for complete search history.

(56) References Cited

U.S. PATENT DOCUMENTS

2012/0105086 A1* 5/2012 Bommer ..... G01N 27/20 324/713

FOREIGN PATENT DOCUMENTS

| | | | | | |
|---|---|---|---|---|---|
| CA | 3129507 | A1 | * | 8/2019 | ..... B42D 15/0086 |
| CN | 113366812 | A | * | 9/2021 | ..... G06F 13/20 |
| JP | 2001501761 | A | * | 2/2001 | |
| JP | 3553050 | B2 | * | 8/2004 | ..... H04N 7/141 |
| JP | 2005050005 | A | * | 2/2005 | |
| JP | WO2004053665 | A1 | * | 4/2006 | |
| KR | 20130062867 | A | * | 6/2013 | ..... H03M 1/12 |

* cited by examiner

*Primary Examiner* — Pinping Sun
(74) *Attorney, Agent, or Firm* — LEE, HONG, DEGERMAN, KANG & WAIMEY

(57) ABSTRACT

Disclosed is a combined type sensor device including a transceiver configured to transmit and receive data to and from a user terminal, a connector combined with a sensor module, and a processor configured to identify a type of the sensor module, to transmit the identified type of the sensor module to the user terminal through the transceiver, to update the sensor module based on a firmware file received from the user terminal through the transceiver, and to change communication setting according to the identified type of the sensor module.

12 Claims, 9 Drawing Sheets

COMBINED TYPE SENSOR DEVICE COMBINED WITH SENSOR MODULE

CROSS-REFERENCE TO RELATED APPLICATIONS

Pursuant to 35 U.S.C. § 119(a), this application claims the benefit of earlier filing date and right of priority to Korean Patent Application No. 10-2022-0046048, filed on Apr. 14, 2022, the contents of which are hereby incorporated by reference herein in its entirety.

FIELD

The present disclosure relates to a combined type sensor device combined with a sensor module, and more particularly to a combined type sensor device for sensing by being combined with each of a plurality of sensor modules including a sensor for a specific device.

BACKGROUND

Recently, due to the continued smartization of home appliances, new sensors have been added to newly released products. In addition, as new sensors are added, new functions have been added to home appliances.

However, home appliances that have already been released have a problem in that new sensors need to be added as hardware. In order to replace with a new sensor, there is a problem in that a new sensor needs to be added and reassembled after disassembling the home appliance.

Therefore, there is a need for a technology for combining and using a new sensor without disassembling the product.

SUMMARY

An object of an embodiment of the present disclosure is to provide a combined type sensor device combined with sensor modules specialized for various home appliances in use as necessary.

An object of an embodiment of the present disclosure is to provide a combined type sensor device for updating firmware by automatically recognizing a type of the combined sensor module.

An object of an embodiment of the present disclosure is to provide a combined type sensor device for solving a communication disconnection problem according to a product use environment by differently setting communication setting depending on a type of a combined sensor module.

An embodiment provides a combined type sensor device including a transceiver configured to transmit and receive data to and from a user terminal, a connector combined with a sensor module, and a processor configured to identify a type of the sensor module, to transmit the identified type of the sensor module to the user terminal through the transceiver, to update the sensor module based on a firmware file received from the user terminal through the transceiver, and to change communication setting according to the identified type of the sensor module.

The connector may include a coupling member including at least one groove formed thereon.

The sensor module may include a specific resistor part having a different resistivity value for each type of the sensor module, the combined type sensor device may further include a fixed resistor part having a predetermined fixed resistance value, and the processor may identify the type of the sensor module based on an output voltage when the specific resistor part and the fixed resistor part are connected.

The sensor module may further include a specialized sensor part including a specialized sensor specialized for a specific product.

When the sensor module is a sensor module for a washing machine, the specialized sensor part may include a turbidity sensor.

The combined type sensor device may further include a common sensor part including a sensor that is commonly applied to a product.

When the type of the sensor module is a first sensor module, the processor may set Bluetooth Low Energy (BLE) Tx power to a maximum value.

The transceiver may include a plurality of antennas having directionality for receiving communication signals in different directions for Bluetooth Low Energy (BLE) communication and a switch for switching to each of the plurality of antennas, and the processor may activate an antenna switching operation and controls the switch to control switching to another second antenna whenever a disconnection phenomenon occurs in a communication signal received through a first antenna among the plurality of antennas.

The processor may set mode setting of Bluetooth communication used by the transceiver to a Coded PHY mode.

The processor may store sensing information generated by the combined type sensor device in a buffer and activates a batching mode of re-transmitting the sensing information stored in the buffer to the user terminal through the transceiver when communication with the user terminal is connected again after disconnection.

When frequency sensitivity of the transceiver and the user terminal is greater than or equal to a predetermined value, the processor may activate an auto connection mode in which the transceiver performs communication connection with the user terminal.

When the type of the sensor module is a second sensor module, the processor may set Bluetooth Low Energy (BLE) Tx power to a minimum value.

The processor may deactivate an antenna switching operation, may set mode setting of Bluetooth communication used by the transceiver to a 1M PHY mode, may deactivate a batching mode, and may deactivate an auto connection mode.

DETAILED DESCRIPTION

Hereinafter, embodiments of the present disclosure will be described in further detail with reference to the accompanying drawings. In the following description, the terms "module" and "unit", which are used herein to signify components, are merely intended to facilitate explanation of the present disclosure, and the terms do not have any distinguishable difference in meaning or role.

Figure 1:
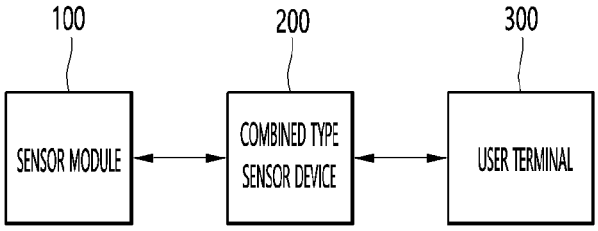
FIG. 1 is a diagram showing a sensing system according to an embodiment of the present disclosure.

FIG. 1 is a diagram showing a sensing system according to an embodiment of the present disclosure.

Referring to FIG. 1, a sensing system 10 may include a sensor module 100, a combined type sensor device 200, and a user terminal 300.

The sensor module 100 may be a sensor module including a specialized sensor specialized for a specific product. For example, a sensor module for a washing machine may include a turbidity sensor for measuring the turbidity of water of the washing machine, a sensor module for a refrigerator may include a gas sensor for measuring gas in the refrigerator, and a sensor module for an air conditioner may include a radar sensor for determining whether a user is present.

The combined type sensor device 200 may include sensors that are commonly applicable to products and may use a specialized sensor including the specific sensor module 100 combined therewith for a specific product.

The combined type sensor device 200 may transmit information measured by various sensors of the sensor module 100 and the combined type sensor device 200 to the user terminal 300.

The user terminal 300 may provide an interface that receives information measured from the combined type sensor device 200 or manages the combined type sensor device 200. The user terminal 300 may be implemented as a fixed device or a mobile device, such as a desktop computer, a mobile phone, a smart phone, a notebook computer, a tablet PC, and a wearable device.

Figure 2:
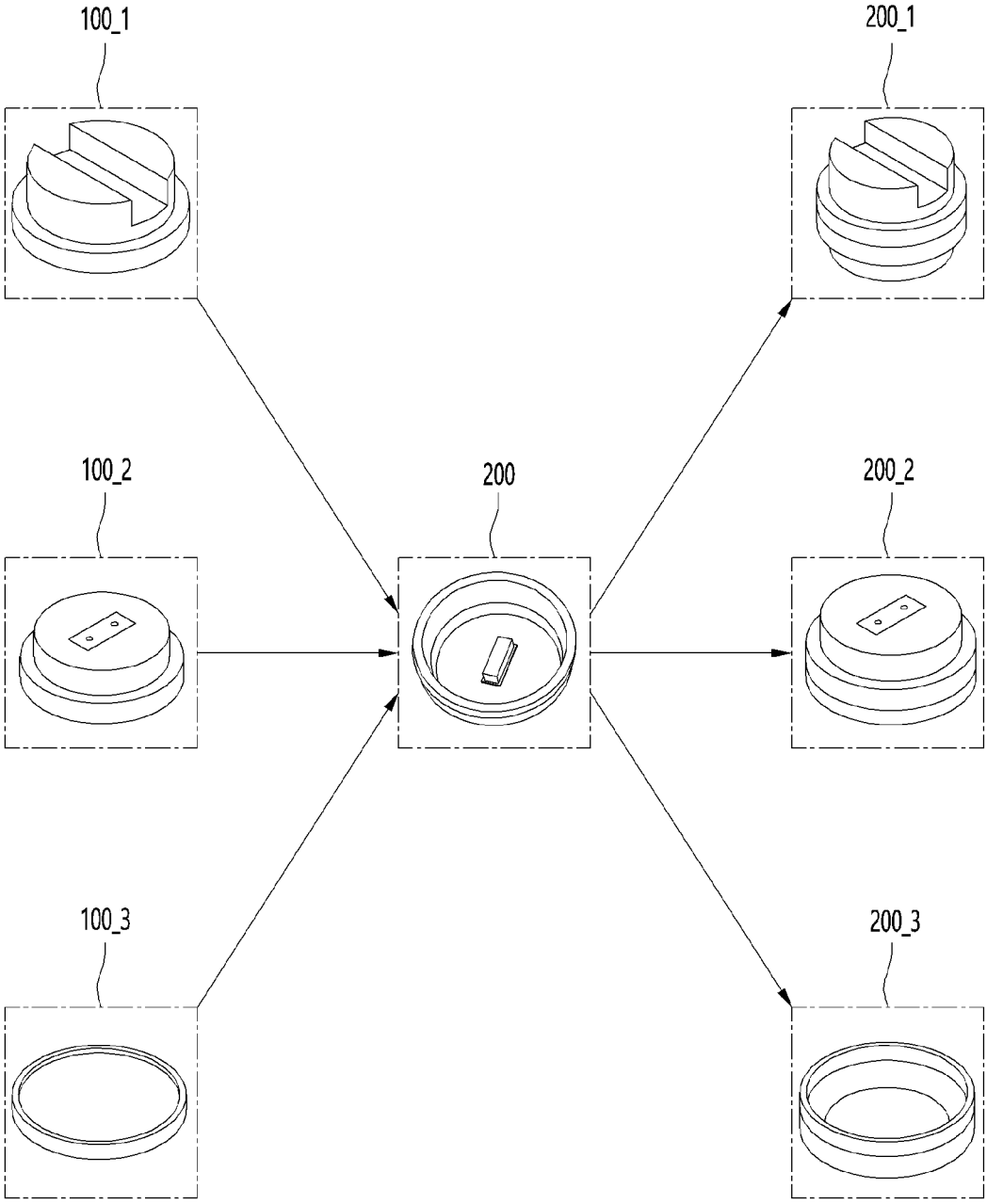
FIG. 2 is a diagram for explaining a method of combining a sensor module and a combined type sensor device according to an embodiment of the present disclosure.

FIG. 2 is a diagram for explaining a method of combining a sensor module and a combined type sensor device according to an embodiment of the present disclosure.

Referring to FIG. 2, a plurality of sensor modules 100_1, 100_2, and 100_3 may be combined type sensor devices 200_1, 200_2, and 200_3 that are combined with the combined type sensor device 200 and are to be used in a specific product, respectively.

For example, the combined type sensor device 200 may be a combined type sensor device 200_1 for a washing machine, which is combined with a sensor module 100_1 for a washing machine, which includes a turbidity sensor for measuring the turbidity of water. The combined type sensor device 200 may be a combined type sensor device 200_2 for a refrigerator, which is combined with a sensor module 100_2 for a refrigerator, including a gas sensor for measuring gas in a refrigerator. The combined type sensor device 200 may be a combined type sensor device 200_3 for an air conditioner, which is combined with a sensor module 100_3 for an air conditioner, including a radar sensor for determining whether a user is present.

Figure 3:
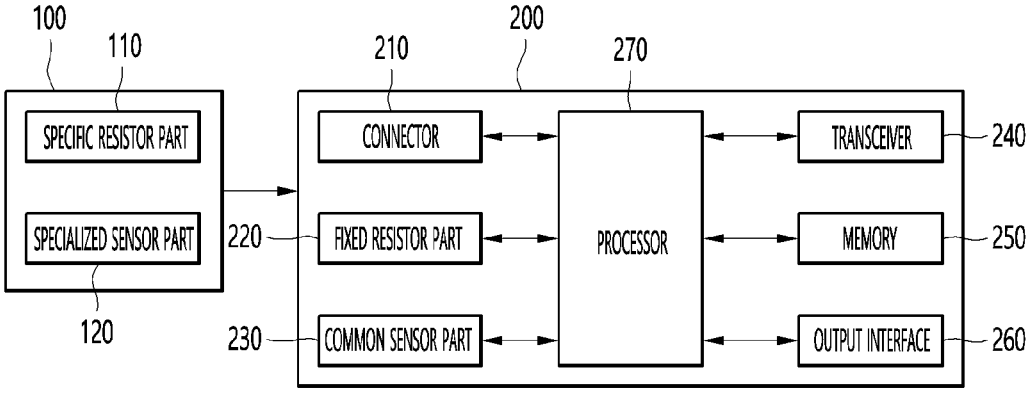
FIG. 3 is a block diagram showing a sensor module and a combined type sensor device according to an embodiment of the present disclosure.

FIG. 3 is a block diagram showing a sensor module and a combined type sensor device according to an embodiment of the present disclosure.

Referring to FIG. 3, the sensor module 100 may include a specific resistor part 110 and a specialized sensor part 120.

The specific resistor part 110 may include a specific resistor having a unique resistance value for identifying a type of the sensor module 100 by the combined type sensor device 200 when the sensor module 100 is combined with the combined type sensor device 200.

For example, the sensor module 100_1 for a washing machine, the sensor module 100_2 for a refrigerator, and the sensor module 100_3 for an air conditioner may include specific resistors having different resistance values, respectively. The sensor module 100_1 for a washing machine, the sensor module 100_2 for a refrigerator, and the sensor module 100_3 for an air conditioner may include specific resistors having resistance values of 200 kΩ, 300 kΩ, and 100 kΩ, respectively. The combined type sensor device 200 may identify a type of the sensor module 100 based on a resistivity value of the specific resistor part 110 of the sensor module 100.

The specialized sensor part 120 may include a specialized sensor specialized for a specific product. For example, the sensor module 100_1 for a washing machine may include a turbidity sensor for measuring the turbidity of water of a washing machine by the specialized sensor part 120. In this case, the turbidity sensor may be a total dissolved solids (TDS) sensor. The sensor module 100_2 for a refrigerator may include a gas sensor for measuring gas in the refrigerator. The gas sensor may measure a degree of decay of food stored in the refrigerator. The sensor module 100_3 for an air conditioner may include a radar sensor for determining whether a user is present. In this case, the radar sensor may include a millimeter wave (mmWave) sensor.

The combined type sensor device 200 may include a connector 210, a fixed resistor part 220, a common sensor part 230, a transceiver 240, a memory 250, an output interface 260, and a processor 270.

The connector 210 may include a coupling member for combination with the sensor module 100.

The fixed resistor part 220 may include a fixed resistor having a fixed resistor value. The fixed resistor part 220 may include a resistor having a fixed resistance value in order to output a changed voltage depending on a resistivity value of the sensor module 100 when the sensor module 100 is combined with the combined type sensor device 200.

The common sensor part 230 may include a sensor that is commonly applied to products. The common sensor part 230 may include a pressure sensor, a humidity sensor, and a temperature sensor.

The transceiver 240 may transmit and receive data with external devices such as the user terminal 300 using wired and wireless communication technology. In this case, communication technology used by the transceiver 2400 may include Global System for Mobile communication (GSM), Code Division Multi Access (CDMA), Long Term Evolution (LTE), 5G, Wireless LAN (WLAN), Wireless-Fidelity (Wi-Fi), Bluetooth, Bluetooth Low Energy (BLE), Radio Frequency Identification (RFID), Infrared Data Association (IrDA), ZigBee, and Near Field Communication (NFC).

The memory 250 may store data for supporting various functions of the combined type sensor device 200. For example, the memory 250 may store data received from the user terminal 300.

The output interface 260 may generate output related to visual, auditory or tactile, etc.

In order to drive an application program stored in the processor 270, at least some of components of the combined type sensor device 200 may be controlled. In order to drive the application program, the processor 270 may combine and operate two or more of the components of the combined type sensor device 200.

Figure 4:
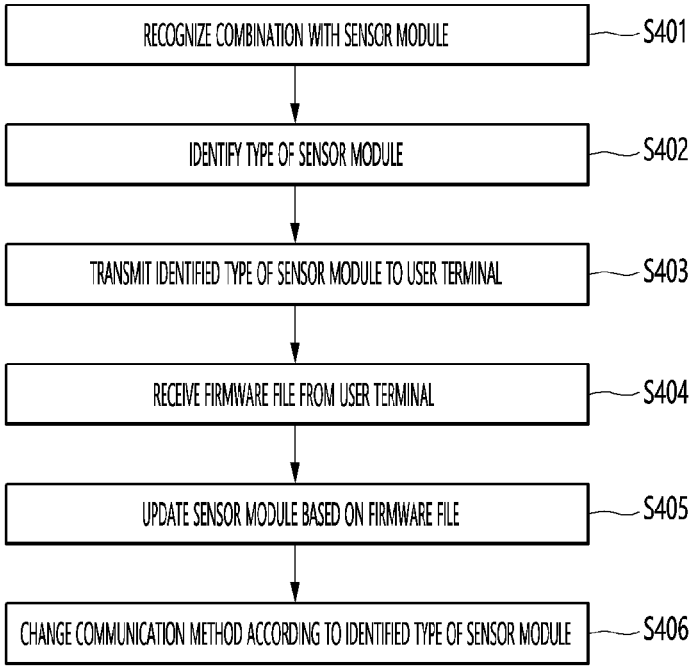
FIG. 4 is a diagram for explaining an operating method of a combined type sensor device according to an embodiment of the present disclosure.

FIG. 4 is a diagram for explaining an operating method of a combined type sensor device according to an embodiment of the present disclosure.

The processor 270 of the combined type sensor device 270 may recognize combination of the sensor module 100 (S410).

For example, the sensor module 100 and the combined type sensor device 200 may be combined through the connector 210 of the combined type sensor device 270.

Figure 5:
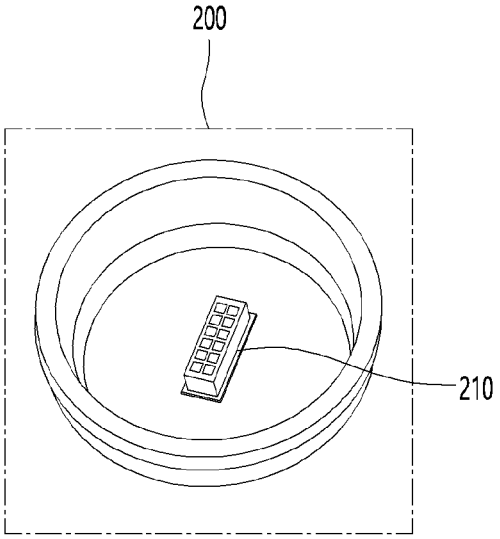
FIG. 5 is a diagram for explaining a connector according to an embodiment of the present disclosure.

FIG. 5 is a diagram for explaining a connector according to an embodiment of the present disclosure.

Referring to FIG. 5, the combined type sensor device 200 may include the connector 210 including a coupling member on which at least one groove is formed for combination with the sensor module 100.

The processor 270 may identify a type of the sensor module 100 (S402).

Figure 6:
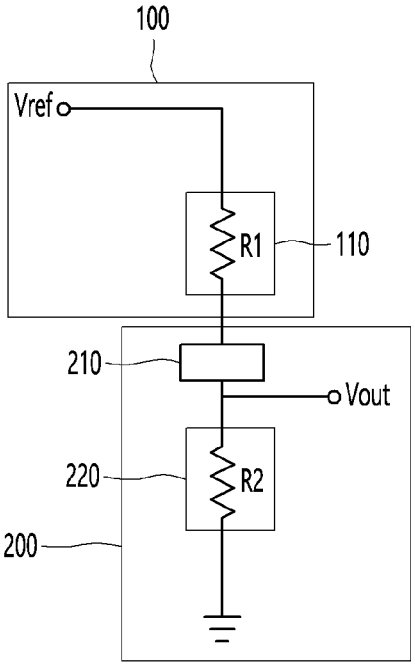
FIG. 6 is a diagram for explaining a method of identifying a sensor module according to an embodiment of the present disclosure.

FIG. 6 is a diagram for explaining a method of identifying a sensor module according to an embodiment of the present disclosure.

Referring to FIG. 6, the sensor module 100 may include the specific resistor part 110. The specific resistor part 110 may have different resistance values for each type of the sensor module 100.

A resistivity value of the specific resistor part 110 may have different values for respective types of the plurality of sensor modules 100. For example, the sensor module 100_1 for a washing machine, the sensor module 100_2 for a refrigerator, and the sensor module 100_3 for an air conditioner may include specific resistors having resistance values of 200 kΩ, 300 kΩ, and 100 kΩ, respectively.

The sensor module 100 and the combined type sensor device 200 may be combined through the connector 210.

The fixed resistor part 220 of the combined type sensor device 200 may be connected to the specific resistor part 110 of the sensor module 100.

When the specific resistor part 110 and the fixed resistor part 220 are connected to each other, a reference voltage $V_{ref}$ of the sensor module 100 may have an output voltage $V_{out}$ shown in Table 1 in the combined type sensor device 200 depending on a resistivity value of the specific resistor part.

TABLE 1

| Type of Sensor Module | Resistivity Value | Output Voltage $V_{out}$ |
|---|---|---|
| Sensor Module for Air Conditioner | 100 kΩ | $1/3*V_{ref}$ |
| Sensor module for Washing Machine | 200 kΩ | $2/3*V_{ref}$ |
| Sensor Module for Refrigerator | 300 kΩ | $3/3*V_{ref}$ |

The processor 270 of the combined type sensor device 200 may identify a type of the sensor module 100 coupled based on the output voltage $V_{out}$ when the specific resistor part 110 and the fixed resistor part 220 are connected.

The processor 270 may transmit the identified type of the sensor module to the user terminal 300 (S403).

The user terminal 300 may receive information on a type of the sensor module from the combined type sensor device 200 and may provide a sensor module management interface for managing the combined type sensor device 200.

Figure 7:
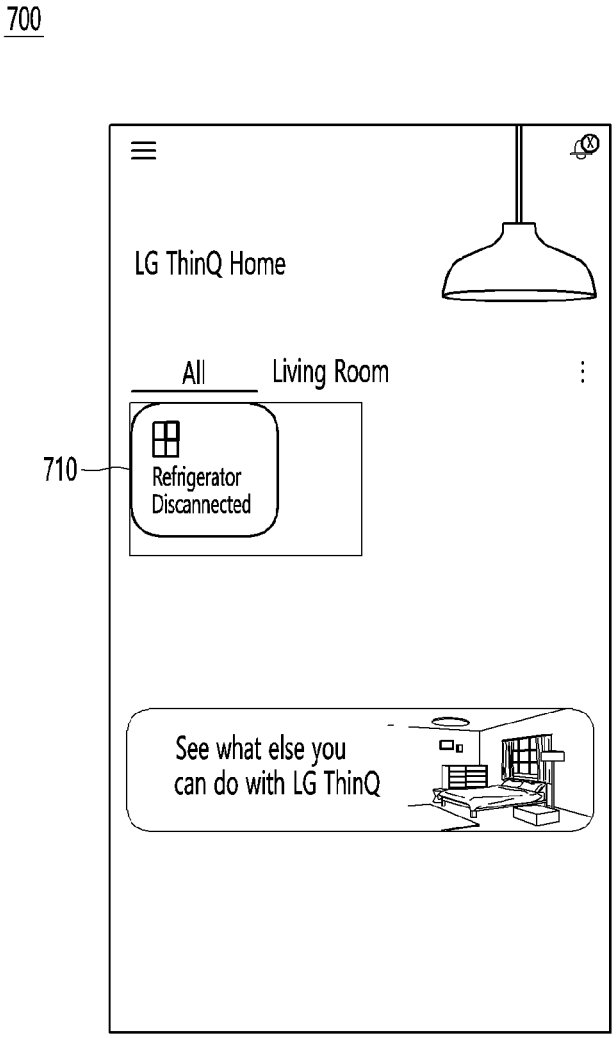
FIG. 7 is a diagram for explaining a combined type sensor module management interface according to an embodiment of the present disclosure.

FIG. 7 is a diagram for explaining a combined type sensor module management interface according to an embodiment of the present disclosure.

Referring to FIG. 7, a sensor module management interface 700 may output sensor module type information 710 to a display of the user terminal 300.

The user terminal 300 may download a firmware file related to firmware and software according to a type of a sensor module, and may transmit a firmware file suitable for the sensor module to the combined type sensor device 200.

Referring back to FIG. 4, the processor 270 may receive a firmware file from the user terminal 300 through the transceiver 240 (S404).

The processor 270 may update the sensor module 100 based on the firmware file (S405).

Thus, the combined type sensor device 200 may maintain an up-to-data firmware update state.

The processor 270 may change communication setting according to the identified type of the sensor module (S460).

For example, when the combined type sensor device 200 is combined with the sensor module 100_1 for a washing machine, the combined type sensor device 200 may detect turbidity in the washing machine. In this case, when the washing machine uses a lot of water and there is a lot of laundry, there may be a problem that Bluetooth Low Energy (BLE) is cut off. Thus, communication setting needs to be changed depending on a type of the sensor module 100. For example, communication setting for the case in which a first sensor module specialized for a product that causes a communication problem due to water using a large amount of water, such as the sensor module 100_1 for a washing machine, is coupled to the combined type sensor device 200 and communication setting for the case in which a second sensor module specialized for a product with a less communication problem caused by water, such as the sensor module 100_2 for a refrigerator or the sensor module 100_3 for an air conditioner, is coupled to the combined type sensor device 200 may be differently set.

The processor 270 may change Bluetooth Low Energy (BLE) communication setting provided by the transceiver 240 according the first sensor module or the second sensor module.

Figure 8:
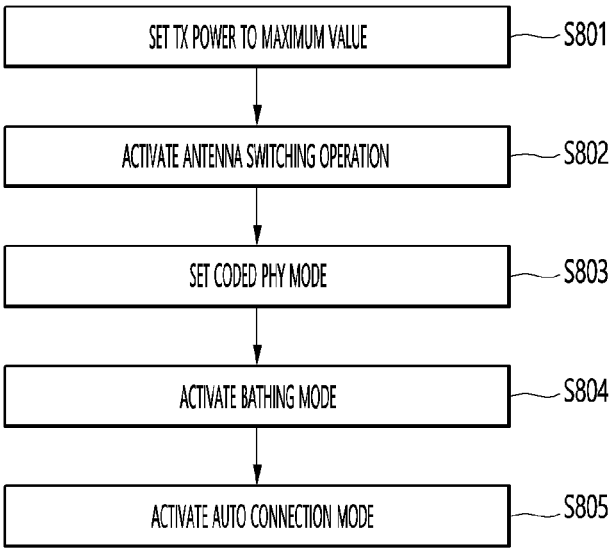
FIG. 8 is a flowchart for explaining a communication setting method in the case of combination of a first sensor module according to an embodiment of the present disclosure.

FIG. 8 is a flowchart for explaining a communication setting method in the case of combination of a first sensor module according to an embodiment of the present disclosure.

The processor 270 may identify a coupled sensor module and may perform first communication setting when the identified type of the sensor module is a first sensor module. The first sensor module may include the sensor module 100_1 for a washing machine.

The processor 270 may change Bluetooth Low Energy (BLE) communication setting provided by the transceiver 240 according to the first sensor module.

The processor 270 may set Bluetooth Low Energy (BLE) Tx power to a maximum value (S801). The maximum value of Bluetooth Low Energy (BLE) Tx power may be differently set for each country, but may be set to 8 dbm to 10 dbm.

The processor 270 may activate an antenna switching operation (S802).

For example, the transceiver 240 may include a plurality of antennas for Bluetooth Low Energy (BLE) communication and may include a switch for switching to each of the plurality of antennas. The plurality of antennas may have directionality for receiving communication signals in different directions, respectively.

The processor 270 may activate the antenna switching operation and controls switching to another second antenna whenever a disconnection phenomenon occurs in a communication signal received through a first antenna among the plurality of antennas.

The processor 270 may set a Coded PHY mode.

The processor 270 may set mode setting of Bluetooth communication used by the transceiver 240.

The Coded PHY mode may be a protocol added to Blue 5.0 and to improve RX sensitivity and to increase reach.

The Coded PHY mode may apply Forward Error Correction (FEC) to a packet to correct a bit error at a receiving side and to lower a bit error rate and may apply a pattern mapper to the packet to improve communication efficiency.

The processor 270 may activate a batching mode (S804).

The processor 270 may set mode setting of Bluetooth communication used by the transceiver 240 to the batching mode.

The processor 270 may activate the batching mode and may store sensing information generated by the sensor module or the combined type sensor device in a buffer.

The processor 270 may activate the batching mode and may store first sensing information generated by the specialized sensor part 120 of the sensor module 100 and second sensing information generated by the common sensor part 230 of a combined type fixed device 200, in the buffer.

The processor 270 may re-transmit the sensing information stored in the buffer to the user terminal 300 through the transceiver 240 when communication with the user terminal 300 is connected again after disconnection.

The processor 270 may activate an auto connection mode (S805).

Since the first sensor module is a sensor module specialized for a product having a problem in communication, a communication disconnect phenomenon may occur, and thus when frequency sensitivity of the transceiver 240 and the user terminal 300 is greater than or equal to a predetermined value, the processor 270 may activate the auto connection mode in which the transceiver 240 automatically performs communication connection with the user terminal 300. Thus, even if communication is cut off, if sensitivity for enabling communication connection again is received, communication connection may be established.

Figure 9:
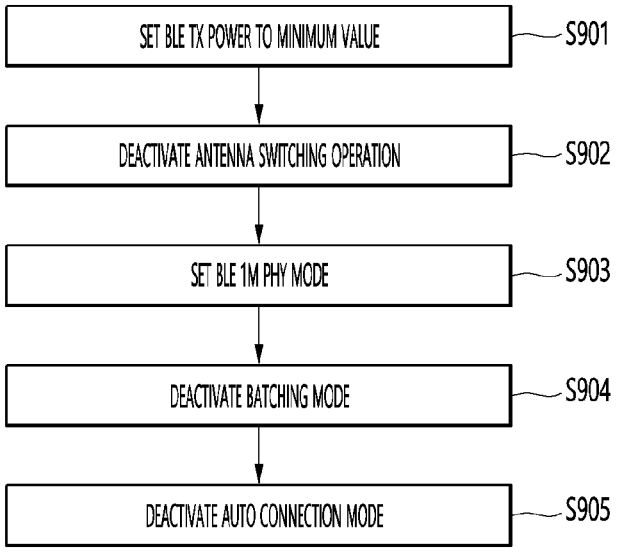
FIG. 9 is a flowchart for explaining a communication setting method in the case of combination of a second sensor module according to an embodiment of the present disclosure.

FIG. 9 is a flowchart for explaining a communication setting method in the case of combination of a second sensor module according to an embodiment of the present disclosure.

The processor 270 may identify a coupled sensor module and may perform second communication setting when the identified type of the sensor module is a second sensor module. The first sensor module may include the sensor module 100_2 for a refrigerator or the sensor module 100_3 for an air conditioner.

The processor 270 may change Bluetooth Low Energy (BLE) communication setting provided from the transceiver 240 according to the second sensor module.

The processor 270 may set Bluetooth Low Energy (BLE) Tx power to a minimum value (S901). For example, the minimum value of the Bluetooth Low Energy (BLE) Tx power may be set to 0 dbm.

The processor 270 may deactivate the antenna switching operation (S902).

When the second sensor module is the sensor module 100_2 for a refrigerator or the sensor module 100_3 for an air conditioner, the combined type sensor device 200 may be fixed during an operation of a product, and thus the antenna switching operation may not be required.

The processor 270 may set a 1M PHY mode (S903).

In the 1M PHY mode, a data transfer rate in the PHY may be fixed to 1 Mbps.

The processor 270 may deactivate the batching mode (S904).

The processor 270 may deactivate the batching mode and may continuously transmit the first sensing information generated by the specialized sensor part 120 of the sensor module 100 and the second sensing information generated by the common sensor part 230 of the combined type fixed device 200 to the user terminal 300 through the transceiver 240.

The processor 270 may deactivate the auto connection mode (S905).

Since the second sensor module is a sensor module specialized for a product with a less communication problem, communication disconnection occurs less frequently, and thus the processor 270 may deactivate the auto connection mode to reduce battery power consumption.

A combined type sensor device according to an embodiment of the present disclosure may be combined with sensor modules specialized for various home appliances in use as necessary.

The combined type sensor device according to an embodiment of the present disclosure may update firmware by automatically recognizing a type of the combined sensor module.

The combined type sensor device according to an embodiment of the present disclosure may solve a communication disconnection problem according to a product use environment by differently setting communication setting depending on a type of a combined sensor module.

Accordingly, the embodiments disclosed in the present disclosure are not intended to limit the technical spirit of the present disclosure, but to explain, and the scope of the technical spirit of the present disclosure is not limited by these embodiments.

The scope of the present disclosure should be construed by the following claims, and all technical ideas within the scope equivalent thereto should be construed as being included in the scope of the present disclosure.

What is claimed is:

1. A combined type sensor device comprising:

a transceiver configured to transmit and receive data to and from a user terminal;

a connector combined with a sensor device; and a processor configured to identify a type of the sensor device from a plurality of sensor device types, to transmit the identified type of the sensor device to the user terminal through the transceiver, to update the identified type of sensor device based on a firmware file relating to the identified type of sensor device that is received from the user terminal through the transceiver, and to change a pre-established communication setting of the transceiver according to the identified type of the sensor device, wherein:

the sensor device includes a specific resistor part having a different resistivity value for each type of the sensor device of the plurality of sensor device types;

the combined type sensor device further includes a fixed resistor part having a predetermined fixed resistance value; and the processor identifies the type of the sensor device based on an output voltage when the specific resistor part and the fixed resistor part are connected.

2. The combined type sensor device of claim 1, wherein the connector includes a coupling member including at least one groove formed thereon.

3. The combined type sensor device of claim 1, wherein the sensor device further includes a specialized sensor part including a specialized sensor specialized for a specific product.

4. The combined type sensor device of claim 3, wherein, based on the sensor device being a sensor device for a washing machine, the specialized sensor part includes a turbidity sensor.

5. The combined type sensor device of claim 3, wherein the combined type sensor device further includes a common sensor part including a sensor that is commonly applied to each of a plurality of products interoperable with the combined type sensor device.

6. The combined type sensor device of claim 1, wherein, based on the type of the sensor device being a first sensor device, the processor sets a Bluetooth Low Energy (BLE) transmit power to a maximum value.

7. The combined type sensor device of claim 6, wherein:

the transceiver includes a plurality of antennas having directionality for receiving communication signals in different directions for BLE communication and an antenna switch for switching to each of the plurality of antennas; and the processor controls the antenna switch to control switching to from a first antenna among the plurality of antennas to a second antenna among the plurality of antennas based on a disconnection phenomenon occurring in a communication signal received through the first antenna.

8. The combined type sensor device of claim 7, wherein the processor sets a Bluetooth communication mode used by the transceiver to a Coded physical layer (PHY) mode based on a predetermined condition or input.

9. The combined type sensor device of claim 8, further comprising a buffer, wherein the processor stores sensing information generated by the combined type sensor device in the buffer and activates a batching mode of re-transmitting the sensing information stored in the buffer to the user terminal through the transceiver based on a communication with the user terminal being connected again after a disconnection.

10. The combined type sensor device of claim 9, wherein, based on a frequency sensitivity of the transceiver and the user terminal being greater than or equal to a predetermined value, the processor activates an auto connection mode in which the transceiver performs a communication connection with the user terminal.

11. The combined type sensor device of claim 1, wherein, when the type of the sensor device is a second sensor device, the processor sets a Bluetooth Low Energy (BLE) transmit power of the transceiver to a minimum value.

12. The combined type sensor device of claim 11, wherein, based on a predetermined condition, the processor deactivates an antenna switching operation of the combined type sensor device, sets the transceiver to a one mega-symbol physical layer (1M PHY) mode, deactivates a pre-existing batching mode, and deactivates a pre-existing auto connection mode.

* * * * *